US007714693B2

(12) United States Patent
Miyamoto

(10) Patent No.: US 7,714,693 B2
(45) Date of Patent: May 11, 2010

(54) SLOW BLOW FUSE AND ELECTRIC JUNCTION BOX

(75) Inventor: Takashi Miyamoto, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 101 days.

(21) Appl. No.: 12/224,860

(22) PCT Filed: Nov. 23, 2006

(86) PCT No.: PCT/JP2006/323368

§ 371 (c)(1),
(2), (4) Date: Sep. 8, 2008

(87) PCT Pub. No.: WO2007/110999

PCT Pub. Date: Oct. 4, 2007

(65) Prior Publication Data

US 2009/0066470 A1 Mar. 12, 2009

(30) Foreign Application Priority Data

Mar. 24, 2006 (JP) ..... 2006-083651
Oct. 16, 2006 (JP) ..... 2006-281830

(51) Int. Cl.
*H01H 85/041* (2006.01)

(52) U.S. Cl. ..... 337/187; 337/186; 337/251; 337/290; 337/295

(58) Field of Classification Search ..... 337/186, 337/187, 198, 227, 251, 290, 295
See application file for complete search history.

(56) References Cited

U.S. PATENT DOCUMENTS 4,080,039 A * 3/1978 Ahroni ..... 439/620.3
4,224,592 A * 9/1980 Urani et al. ..... 337/198
4,544,907 A * 10/1985 Takano ..... 337/262
4,570,147 A 2/1986 Ebi
4,871,990 A 10/1989 Ikeda et al.
4,884,050 A * 11/1989 Kozel ..... 337/264
5,107,387 A * 4/1992 Orton ..... 361/33
5,345,211 A * 9/1994 Muramatsu et al. ..... 337/186
5,398,015 A * 3/1995 Kudo et al. ..... 337/255
5,416,461 A * 5/1995 Totsuka et al. ..... 337/261
5,581,225 A 12/1996 Oh et al.
5,745,023 A * 4/1998 Totsuka ..... 337/160
5,745,024 A * 4/1998 Ohta et al. ..... 337/166
5,767,761 A * 6/1998 Muramatsu et al. ..... 337/197
5,781,094 A * 7/1998 Nakamura et al. ..... 337/238

(Continued)

FOREIGN PATENT DOCUMENTS

JP A-62-086634 4/1987

(Continued)

*Primary Examiner*—Anatoly Vortman
(74) *Attorney, Agent, or Firm*—Oliff & Berridge, PLC

(57) ABSTRACT

A fuse element comprising a pair of female terminal portions into which the other pair of terminals is plugged, and which are disposed in parallel, and a blowout portion for coupling the pair of female terminal portions in a direction perpendicular to the direction in which the other pair of terminals is plugged. A slow blow fuse comprising the fuse element accommodated in a housing made of an insulating resin and is provided with the insertion ports in which the other pair of terminals is plugged into the pair of the female terminal portions in the opposed surfaces of the housing.

11 Claims, 11 Drawing Sheets

U.S. PATENT DOCUMENTS

| | | | | | |
|---|---|---|---|---|---|
| 5,818,320 | A | * | 10/1998 | Matsuoka | 337/198 |
| 5,818,321 | A | * | 10/1998 | Muramatsu et al. | 337/198 |
| 5,883,560 | A | * | 3/1999 | Nakamura et al. | 337/160 |
| 5,883,561 | A | * | 3/1999 | Nakamura et al. | 337/198 |
| 5,886,612 | A | * | 3/1999 | Beckert et al. | 337/197 |
| 5,921,810 | A | * | 7/1999 | Murakoshi | 439/510 |
| 6,144,283 | A | * | 11/2000 | Matsumura | 337/198 |
| 6,828,896 | B2 | * | 12/2004 | Ohashi et al. | 337/205 |
| 7,179,128 | B2 | | 2/2007 | Iwata et al. | |
| 2003/0156005 | A1 | * | 8/2003 | Ohashi et al. | 337/160 |
| 2003/0222752 | A1 | * | 12/2003 | Ohashi et al. | 337/186 |
| 2004/0192113 | A1 | | 9/2004 | Yamashita et al. | |
| 2004/0196135 | A1 | * | 10/2004 | Clair | 337/198 |
| 2005/0275499 | A1 | * | 12/2005 | Kita | 337/186 |

FOREIGN PATENT DOCUMENTS

| | | | | |
|---|---|---|---|---|
| JP | 08022762 | A | * | 1/1996 |
| JP | A-09-293445 | | | 11/1997 |
| JP | A-2001-084889 | | | 3/2001 |
| JP | A-2001-297684 | | | 10/2001 |
| JP | A-2002-056769 | | | 2/2002 |
| JP | A-2004-281078 | | | 10/2004 |
| JP | A-2004-288518 | | | 10/2004 |

* cited by examiner

[Prior Art]

SLOW BLOW FUSE AND ELECTRIC JUNCTION BOX

TECHNICAL FIELD

The present invention relates to a slow blow fuse and an electric junction box and more particularly the present invention is intended to decrease the height of the slow blow fuse having the fuse element and facilitate a work of mounting the slow blow fuse in the electric junction box.

BACKGROUND ART

Conventionally to protect a circuit from eddy current, a fuse is mounted on the electric junction box for distributing a power supply to electric component parts mounted on a car. As disclosed in Japanese Patent Application Laid-Open No. 2004-281078 (patent document 1), the slow blow fuse 1 shown in FIG. 11 is proposed.

In the slow blow fuse 1, the fuse element 5 having the female terminal-shaped input terminal part 2 and the output terminal part 3 connected thereto by the coupling part 4 having the fusing portion 4a is accommodated inside the box-shaped housing 6 made of an insulating resin. The insertion ports (not shown in FIG. 11) through which mating terminals are inserted into the housing 6 are formed through the bottom wall of the housing 6 at positions confronting the input terminal part 2 and the output terminal part 3 of the fuse element 5 so that the mating terminals inserted into the housing 6 through the insertion ports are connected to the input terminal part 2 and the output terminal part 3 respectively.

In the slow blow fuse 1 disclosed in the patent document 1, the coupling part 4 of the fuse element 5 is projected from the input terminal part 2 and the output terminal part 3 in a terminal plugging direction. Thus the fuse element 5 is long in the terminal plugging direction.

In addition in the fuse element 5 of the slow blow fuse 1 disclosed in the patent document 1, the mating terminals can be inserted into the input terminal part 2 and the output terminal part 3 from only the side of the housing 6 where the coupling part 4 is not provided. Therefore in inserting the slow blow fuse 1 accommodating the fuse element 5 into the fuse accommodation portion of the electric junction box, the bottom wall of the housing 6 should be set as the front end at the insertion side.

Ordinarily, the slow blow fuse is inserted into the fuse accommodation portion by using mechanical equipment. In inserting the slow blow fuse 1 into the fuse accommodation portion, it is necessary to position the slow blow fuse 1 in which component parts are irregularly arranged in such a way that the bottom wall of the housing 6 is set as the front end at the insertion side. Thus it is necessary to use a dedicated equipment to do so, which makes the production cost high.

Patent document 1: Japanese Patent Application Laid-Open No. 2004-281078

DISCLOSURE OF THE INVENTION

Problem to be Solved by the Invention

The present invention has been made in view of the above-described problems. It is an object of the present invention to make the height of a fuse element of a slow blow fuse low, allow terminals to be inserted into a female terminal part of the slow blow fuse in two directions, and simplify equipment for inserting the slow blow fuse into a fuse accommodation portion of an electric junction box to decrease a production cost.

Means for Solving the Problem

To solve the above-described problems, the present invention provides a slow blow fuse in which a fuse element is accommodated in a housing made of an insulating resin; and insertion ports into which mating terminals can be inserted from upper and lower sides of the housing;

Wherein the fuse element comprises a pair of female terminal parts, disposed in parallel, into which the mating terminals are plugged; and a fusing portion coupling a pair of the female terminal parts to each other in a direction orthogonal to a direction in which the mating terminals are plugged into the female terminal parts; and the female terminal parts have plugging ports for the mating terminals at vertical upper and lower ends thereof; an edge of a left side surface or a right side surface of one of the female terminal parts and an edge of a left side surface or a right side surface of the other female terminal part are coupled to each other by a coupling part having the fusing portion at a center thereof; and the coupling part is located at a position proximate to one of the plugging ports disposed at the vertical upper and lower ends of the female terminal parts.

In the above-described construction, unlike the conventional art, the coupling part of the fuse element is not projected in the direction in which the mating terminals are inserted into the female terminal parts respectively, but orthogonally to the direction in which the mating terminals are inserted thereinto respectively. Therefore it is possible to shorten the dimension of the female terminal parts in the direction in which the mating terminals are inserted thereinto respectively and thus make the height of the slow blow fuse low.

By projecting the coupling part orthogonally to the direction in which the mating terminals are inserted into the female terminal parts respectively, it is possible to make the height of the slow blow fuse lower than that of the conventional slow blow fuse by 20 to 50%.

The female terminal parts of the fuse element are so configured that the mating terminals can be inserted thereinto respectively from both ends in the terminal plugging direction, and the housing accommodating the fuse element is provided with the insertion ports confronting the plugging ports of the female terminal parts disposed at the vertical upper and lower ends thereof. Therefore it is possible to insert the mating terminals to be connected with the female terminal parts respectively into the female terminal parts respectively from the upper and lower sides of the housing.

As described above, the slow blow fuse of the present invention allows the mating terminals to be inserted into the female terminal parts respectively in the two opposite directions. Thus it is unnecessary to regulate the insertion direction of the slow blow fuse to the upward direction or the downward direction. Therefore it is possible to mount the slow blow fuse inside a fuse accommodation portion of an electric junction box in both the upward direction or the downward direction.

Conventionally in equipment for inserting the slow blow fuse into the fuse accommodation portion of the electric junction box, it is necessary to use an apparatus for regulating the posture of the slow blow fuse so that a wall portion thereof through which the insertion port is formed is located at the lower side thereof. But owing to the use of the slow blow fuse of the present invention, it is unnecessary to provide the equipment with an apparatus for regulating the insertion direction of the slow blow fuse to the upward direction or the downward direction. Therefore it is possible to simplify the construction of the equipment and decrease the cost.

Because the insertion ports are formed through the confronting walls of the housing, the heat radiation performance can be enhanced.

The housing has a main body, uncovered at an upper portion thereof, which is composed of a bottom wall, a side wall, and a cover for closing said uncovered upper portion of said main body; and said insertion ports are formed through said bottom wall of said main body and said cover confronting said bottom wall.

The main body of the housing and the cover are coupled to each other by locking the main body and the cover to each other after the fuse element is accommodated inside the main body of the housing.

The housing may be provided with upper and lower covers for closing the main body of the housing uncovered at the upper portion thereof. In this case, one of the covers constitutes the bottom wall of the main body of the housing.

Probe pin insertion ports, for examining electrical conductivity, continuous with the insertion ports respectively are provided.

The probe pin insertion port is formed through the bottom wall formed continuously with the insertion port formed through the bottom of the main body of the housing and the insertion port formed through the cover. Therefore it is possible to conduct a conductivity test by inserting a probe pin into the probe pin insertion port when the housing is used upside down or not.

A flange portion is projected from a periphery of the bottom wall of the main body of the housing.

The peripheral edge of the cover for closing the uncovered upper portion of said main body is projected from the side wall of the main body of the housing. Thus the flange portion is projected from the periphery of the bottom wall of the main body of the housing so that the outer configuration of the flange portion and that of the cover are identical to each other. By forming the flange portion on the bottom wall of the main body of the housing in such a way that the slow blow fuse is accommodated in a box with the flange portion closely engaging a mounting portion of the box, the cover closely engages the mounting portion of the box without being loosened, when the cover is mounted on the mounting portion of the box with the slow blow fuse turned upside down.

It is preferable that a concave portion or/and a convex portion for placing the slow blow fuse in position in a fuse accommodation portion and preventing an erroneous connection are formed on an outer surface of the housing.

For example, when the concave portion is formed on the outer surface of the bottom wall of the main body of the housing, the concave portion is also formed on the outer surface of the cover at a position corresponding to the concave portion formed on the outer surface of the bottom wall.

The present invention provides an electric junction box having a fuse accommodation portion for accommodating a slow blow fuse.

It is preferable that a bottom wall of the fuse accommodation portion is provided with a convex portion or/and a concave portion which engage the concave portion or/and the convex portion formed on the housing.

In the above-described construction, when the predetermined slow blow fuse is accommodated in the fuse accommodation portion, the convex portion fits in the concave portion. Thus the slow blow fuse can be inserted into the fuse accommodation portion to a predetermined normal position thereof. On the other hand, when a slow blow fuse other than the predetermined slow blow fuse is accommodated in the fuse accommodation portion, the convex portion interferes with the bottom wall of the fuse accommodation portion or the insertion-side front end surface of the housing of the slow blow fuse. Thus the slow blow fuse cannot be inserted into the fuse accommodation portion to the predetermined normal position. Thereby it is possible to prevent the slow blow fuse from being erroneously inserted into the fuse accommodation portion to the predetermined normal position.

Effect of the Invention

As described above, according to the present invention, the coupling part of the fuse element is projected orthogonally to the direction in which the mating terminals are inserted into the female terminal parts respectively. Therefore it is possible to shorten the dimension of the female terminal parts in the direction in which the mating terminals are inserted thereinto respectively and thus make the height of the slow blow fuse low.

The female terminal parts of the fuse element are so configured that the mating terminals can be inserted thereinto from both ends in the terminal plugging direction, and the housing accommodating the fuse element is provided with the insertion ports confronting the plugging ports of the female terminal parts disposed at the vertical upper and lower ends thereof. Therefore it is possible to insert the mating terminals to be connected with the female terminal parts respectively into the female terminal parts respectively in two opposite directions.

In equipment for inserting the slow blow fuse into the fuse accommodation portion of the electric junction box, it is possible to simplify the construction of an apparatus for regulating the posture of the slow blow fuse and hence decrease the cost.

EXPLANATION OF REFERENCE NUMERALS AND SYMBOLS

Figure 1:
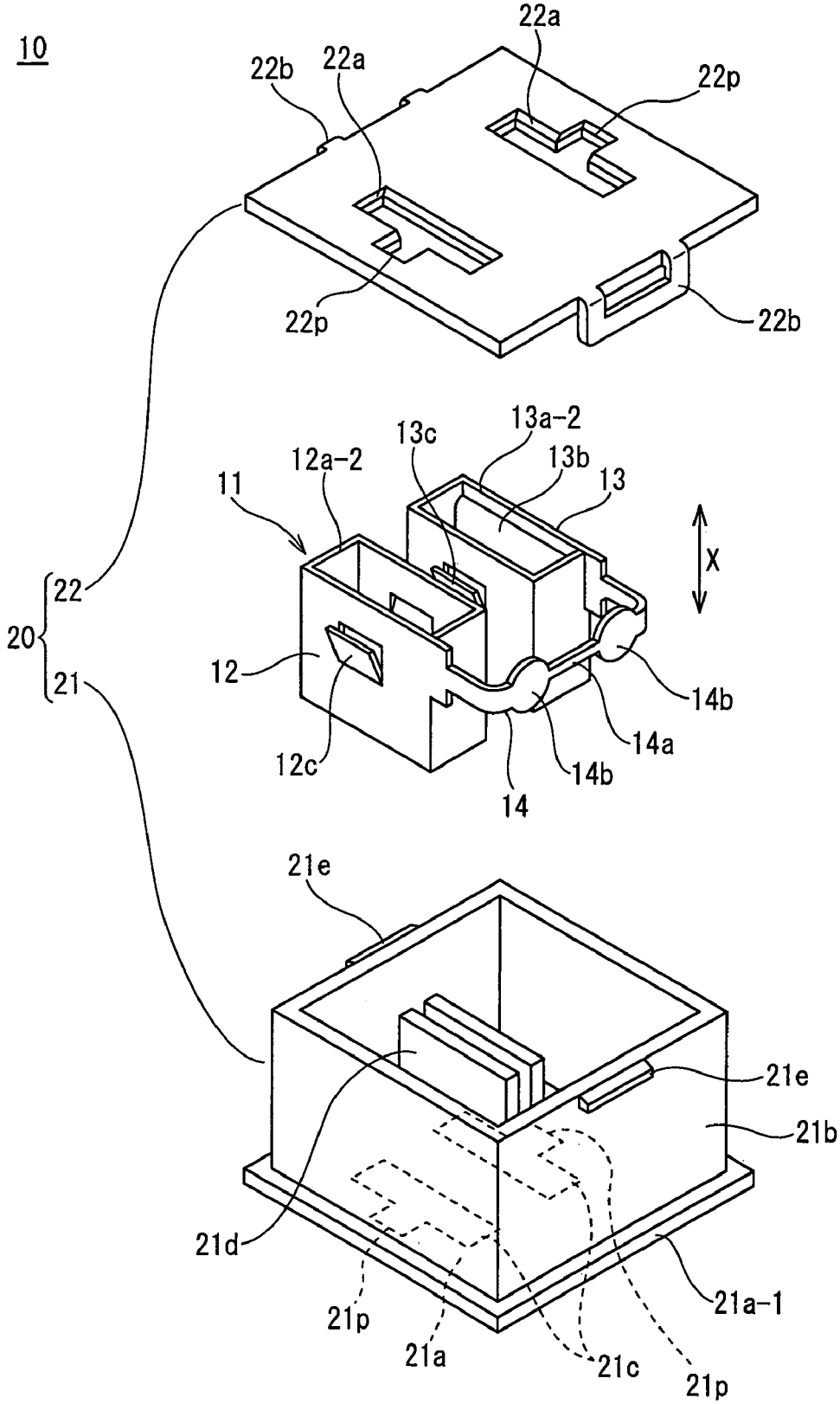
FIG. 1 is an exploded perspective view of a slow blow fuse of a first embodiment of the present invention.
Figure 2A:
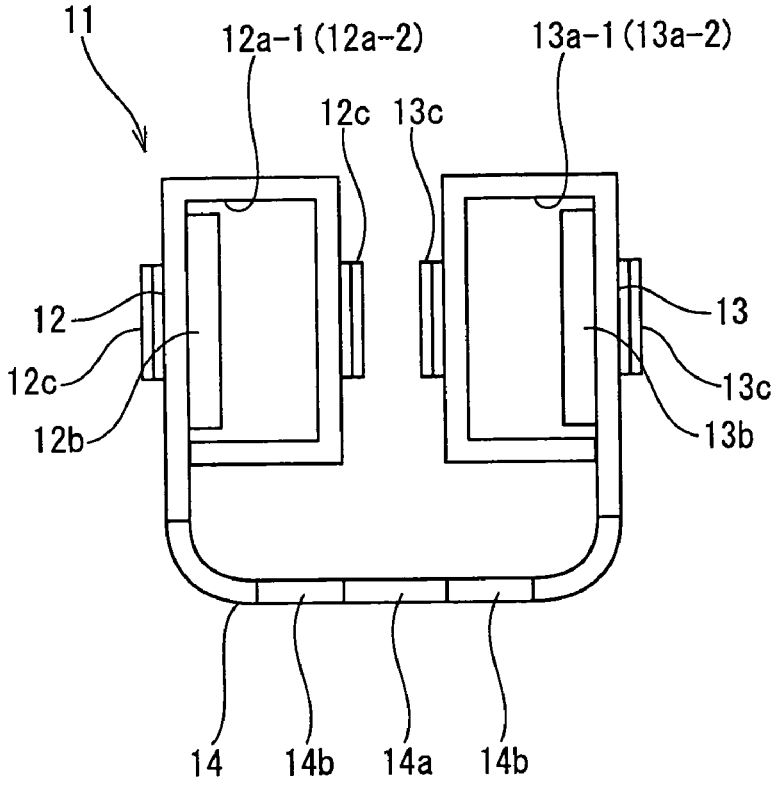
FIG. 2 shown a fuse element of the slow blow fuse, in which (A) is a plan view, and (B) is a front view.
Figure 2B:
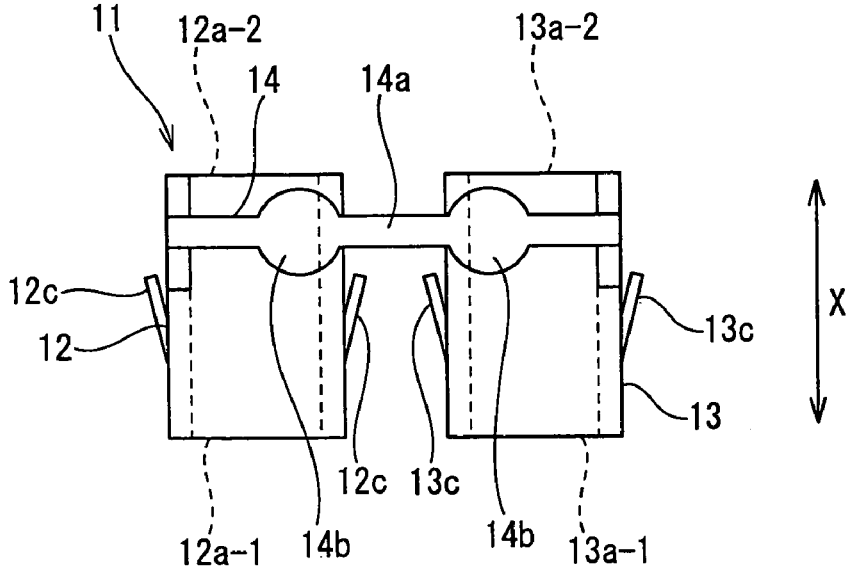
Figure 3A:
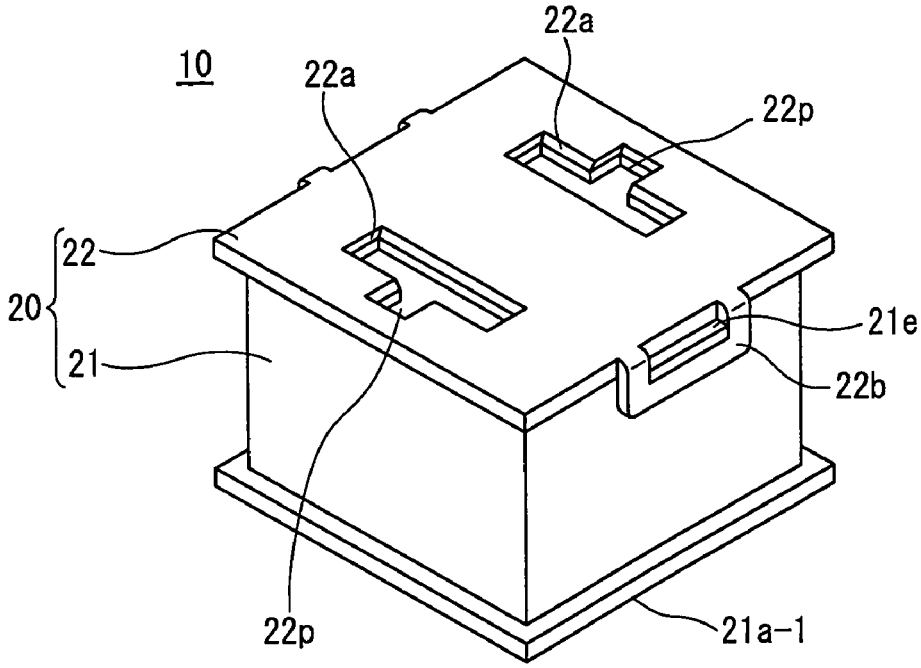
FIG. 3 shows the slow blow fuse, in which (A) is a perspective view, and (B) is a plan view.
Figure 3B:
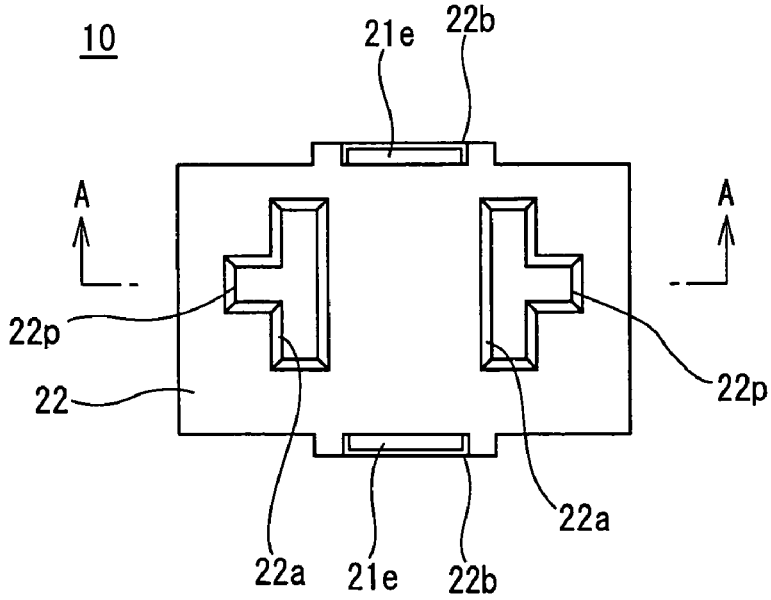

10: slow blow fuse
11: fuse element
12: input terminal part
13: output terminal part
14: coupling part
14*a*: fusing portion
20: housing
21: main body
21*a*: bottom wall
21*a*-1: flange
21*c*: insertion port for terminal
21*p*: probe pin insertion port
22: cover
22*a*: insertion port for terminal
22*p*: probe pin insertion port
23: convex portion
24: concave portion
30: mating terminal
40: electric junction box
45: fuse accommodation portion
45*a*: bottom wall
45*b*: concave portion
45*c*: convex portion

BEST MODE FOR CARRYING OUT THE INVENTION

The embodiments of the present invention are described below with reference to the drawings.

FIGS. 1 through 5 show a first embodiment of the present invention. A slow blow fuse 10 includes a fuse element 11 having a pair of female terminal-shaped input and output terminal parts 12, 13 continuous with each other by a coupling part 14 having a fusing portion 14*a*; and a box-shaped housing 20, made of an insulating resin, which accommodates the fuse element 11.

The fuse element 11 is formed by punching a conductive metal plate into a required configuration and thereafter bending an obtained metal piece. The input terminal part 12 of the fuse element 11 and the output terminal part 13 thereof are so disposed that plugging directions of mating terminals to be connected thereto are parallel with each other. Plugging ports 12*a*-1, 12*a*-2, 13*a*-1, and 13*a*-2 through which the mating terminals are inserted thereinto are formed at upper and lower ends of the input terminal part 12 and the output terminal part 13 in the terminal plugging direction so that the mating terminals can be inserted thereinto from opposed both sides in a terminal plugging direction X. One side wall of each of the input terminal part 12 and the output terminal part 13 is folded inward at the plugging ports 12*a*-1, 13*a*-1 disposed at one end of the input terminal part 12 and the output terminal part 13 in the terminal plugging direction X, and a portion of the one side wall rearward from the folded position is folded inward again at a position near the other end thereof to form elastic pieces 12*b*, 13*b*. The mating terminals inserted into the input terminal part 12 and the output terminal part 13 respectively are sandwiched between the elastic piece 12*b* and a wall confronting the elastic piece 12*b* and between the elastic piece 13*b* and a wall confronting the elastic piece 13*b* respectively. Locking pieces 12*c*, 13*c* are formed on the input terminal part 12 and the output terminal part 13 respectively by cutting and raising a portion of the confronting side walls of each of the input terminal part 12 and the output terminal part 13.

The coupling part 14 coupling an edge of one side wall surface of the input terminal part 12 and that of one side wall surface of the output terminal part 13 to each other is provided by projecting the coupling part 14 in a direction orthogonal to the terminal plugging direction X of the mating terminals to be plugged into the input terminal part 12 and the output terminal part 13 respectively with the coupling part 14 spanning the input terminal part 12 and the output terminal part 13. A narrow fusing portion 14*a* is provided at a central portion of the coupling part 14 in a direction in which the coupling part 14 is extended. A circular bulged portion 14*b* is provided at both sides of the fusing portion 14*a* to enhance heat radiation performance of the coupling part 14 at the bulged portion 14*b* so that the fusing portion 14*a* can be prevented from being fused by a short-time eddy current.

In the first embodiment, by projecting the coupling part 14 orthogonally to the terminal plugging direction X, the height of the input terminal part 12 and that of the output terminal part 13 in the terminal plugging direction is 70% of that of the fuse element of the conventional slow blow fuse having the coupling part projected in the terminal plugging direction. That is, the height of the input terminal part 12 and that of the output terminal part 13 in the terminal plugging direction is 30% less than that of the fuse element of the conventional slow blow fuse.

The housing 20 accommodating the fuse element 11 includes a main body 21 having a bottom wall 21*a*, a side wall 21*b* projected from the periphery of the bottom wall 21*a*, and a flange portion 21*a*-1 projected from the periphery of the bottom wall 21*a*; and a flat plate-shaped cover 22 closing the uncovered main body 21. The outer configuration of the flange portion 21*a*-1 projected from the bottom wall 21*a* and that of the cover 22 are set identically to each other.

Insertion ports 21*c* are formed through the bottom wall 21*a* of the main body 21 at positions confronting the plugging port 12*a*-1 of the input terminal part 12 of the fuse element 11 to be accommodated inside the housing 20 and the plugging port 13*a*-1 of the output terminal part 13 thereof. Insertion ports 22*a* are formed through the cover 22 at positions confronting the plugging port 12*a*-2 of the input terminal part 12 of the fuse element 11 to be accommodated inside the housing 20 and the plugging port 13*a*-2 of the output terminal part 13 thereof.

The positions of a pair of the insertion ports 21*c* formed through the bottom wall 21*a* of the main body 21 and those of a pair of the insertion ports 22*a* formed through the cover 22*c* are vertically correspondent to each other.

Conductivity-examining probe pin insertion ports 21*p*, 22*p* are formed continuously with an outer edge of a central position of a pair of the insertion ports 21*c* of the bottom wall 21*a* and an outer edge of a central position of a pair of the insertion ports 22*p* of the cover 22 respectively.

Figure 4:
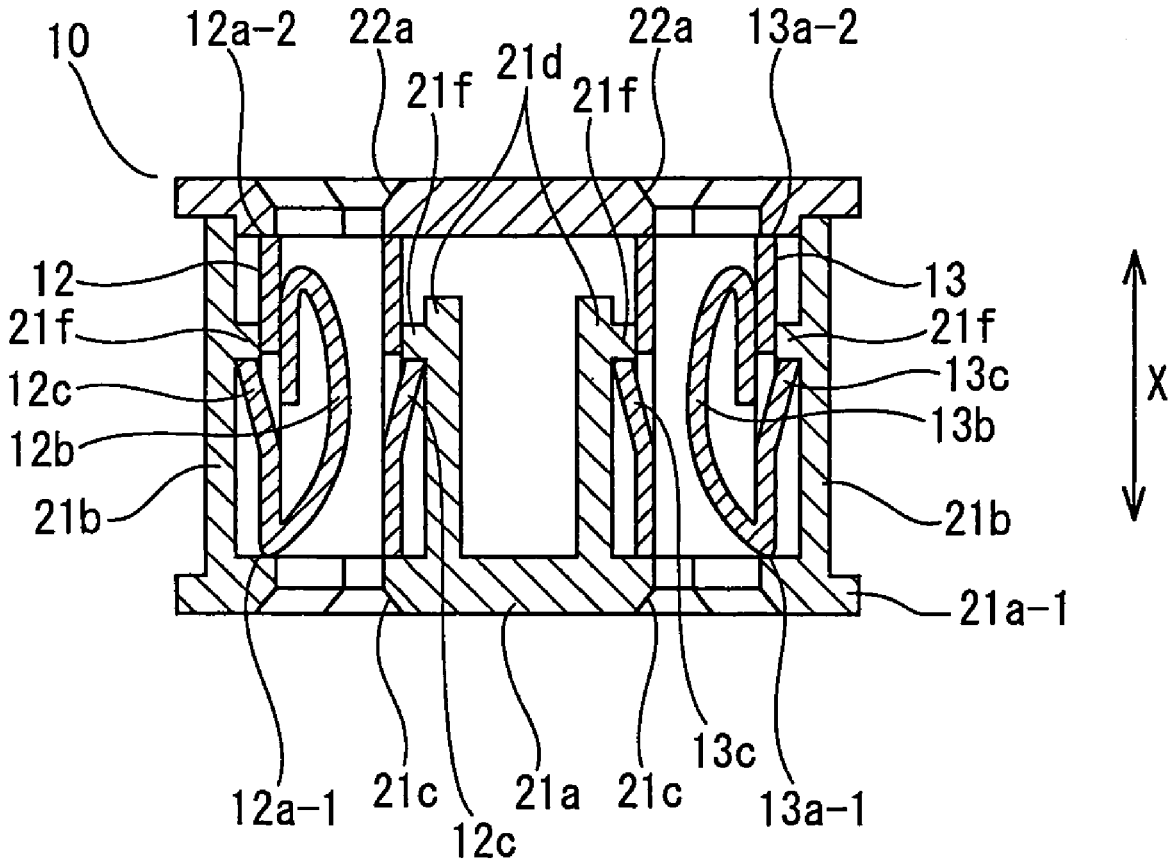
FIG. 4 is a sectional view taken along a line A-A.

Inside the main body 21, a pair of partitioning walls 21*d* is projected upward from the bottom wall 21*a*. Lances 21*f* for locking the locking piece 12*c* of the input terminal part 12 and the locking piece 13*c* of the output terminal part 13 thereto respectively are provided on outer surfaces of the partitioning walls 21*d* and inner surfaces of the side wall 21*b* confronting thereto. When the input terminal part 12 of the fuse element 11 and the output terminal part 13 thereof are accommodated between the partitioning wall 21*d* and the side wall 21*b*, as shown in FIG. 4, the lances 21*f* lock the tip of the locking piece 12*c* formed on the input terminal part 12 and the tip of the locking piece 13*c* formed on the output terminal part 13 thereto respectively. Thereby the fuse element 11 is fixedly placed in position inside the main body 21.

A locking claw 21*e* is provided at an upper end of each of the confronting side walls 21*b* of the main body 21. A locking frame 22*b* is formed on the cover 22. After the fuse element 11 is accommodated inside the main body 21, the cover 22 is placed on the uncovered main body 21, and the locking claw 21*e* of the main body 21 is locked to the locking frame 22*b* of the cover 22 to lock the main body 21 and the cover 22 to each other.

In the slow blow fuse 10, the plugging ports 12*a*-1, 12*a*-2, 13*a*-1, and 13*a*-2 are provided at the upper and lower ends of the input terminal part 12 of the fuse element 11 and the output terminal part 13 thereof in the terminal plugging direction, and the insertion ports 21*c* and 22*a* are formed through the bottom wall 21*a* of the housing 20 and the cover 22 respectively. Therefore the mating terminals 30 to be connected with the fuse element 11 can be inserted into the slow blow fuse 10 from both the upper and lower sides thereof.

Figure 5A:
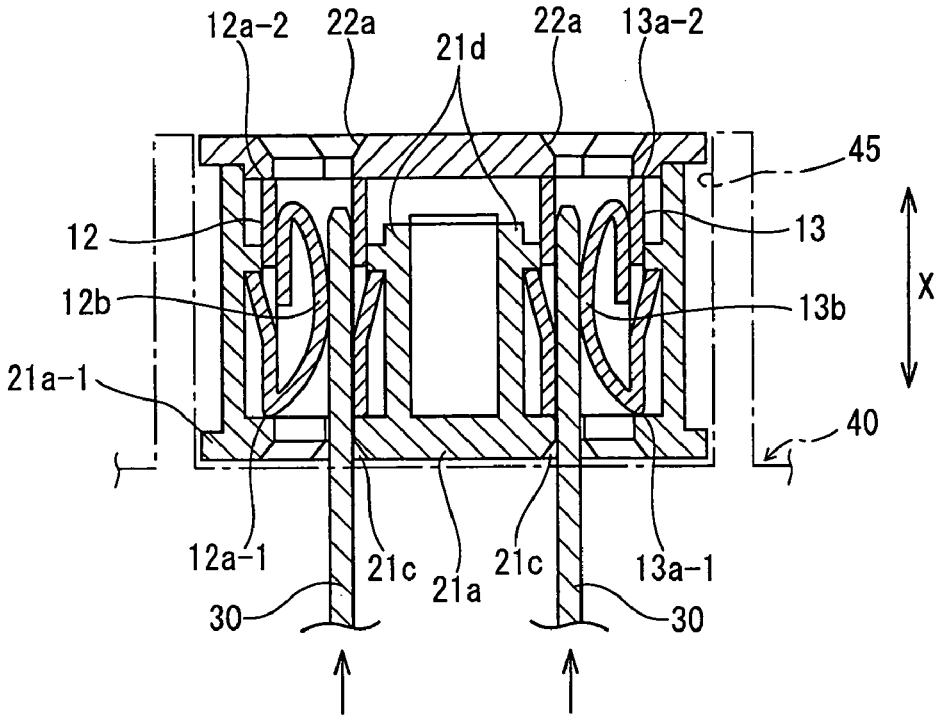
FIG. 5(A) is a sectional view showing a state in which a terminal is inserted into the slow blow fuse from a lower surface thereof to connect the terminal to a female terminal, and 5(B) is a sectional view showing a state in which the terminal is inserted into the slow blow fuse from an upper surface thereof to connect the terminal to the female terminal.
Figure 5B:
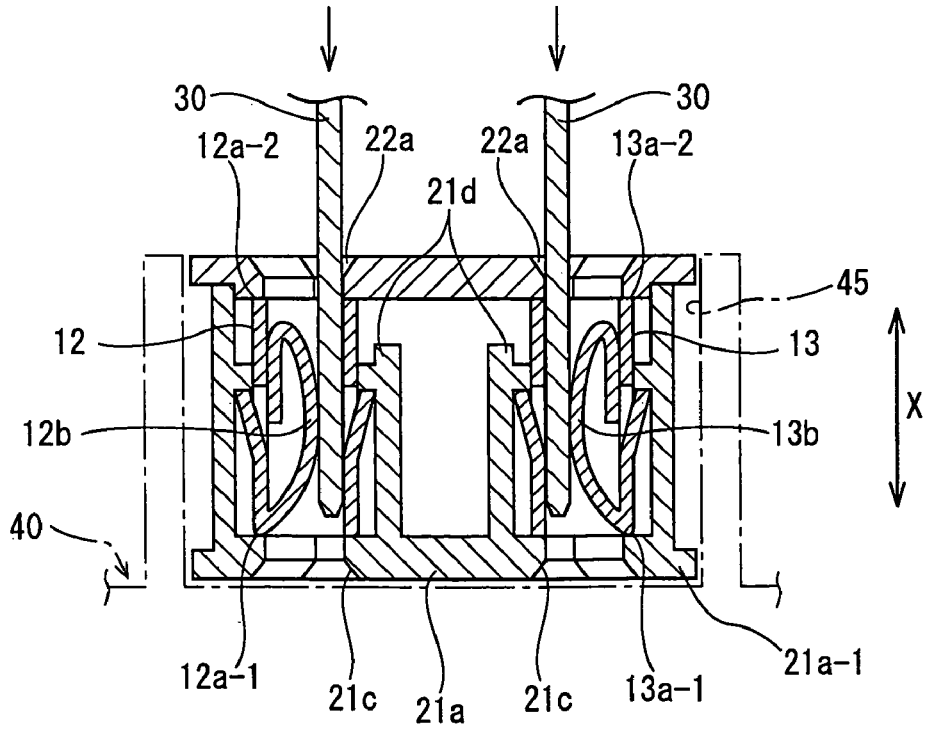

That is, as shown in FIGS. 5(A) and 5(B), when the tab-shaped mating terminals 30 projected inside a fuse accommodation portion 45 of an electric junction box 40 in which the slow blow fuse 10 is to be mounted are inserted into the housing 20 through the insertion port 21*c* of the bottom wall 21*a* or the insertion port 22*a* of the cover 22, the mating terminals 30 are sandwiched between the one elastic piece 12*b* of the input terminal part 12 and the side wall 21*b* confronting thereto and between the elastic piece 13*b* of the output terminal part 13 and the other side wall 21*b* confronting thereto respectively and connected to the input terminal part 12 and the output terminal part 13 respectively.

In the above-described construction, the mating terminals 30 can be connected to the input terminal part 12 and the output terminal part 13 respectively by inserting the mating terminals 30 into the slow blow fuse 10 from both the upper and lower sides thereof. Thus for example, in equipment for inserting the slow blow fuse 10 into the fuse accommodation portion 45 of the electric junction box 40, it is unnecessary to regulate the insertion direction of the slow blow fuse 10 to the upward direction or the downward direction. Therefore it is unnecessary to provide a dedicated equipment for regulating the insertion direction of the slow blow fuse 10 to the upward direction or the downward direction and hence simplify the construction of the equipment and decrease the production cost.

Because the insertion ports 21*c* and 22*a* are formed through confronting upper and lower walls of the housing 20, the heat radiation performance can be enhanced.

Further because the coupling part 14 having the fusing portion 14*a* is projected orthogonally to the terminal plugging direction X of the mating terminals 30 to be inserted into the input terminal part 12 and the output terminal part 13, it is possible to shorten the dimension of the input terminal part 12 and that the output terminal part 13 in the terminal plugging direction X and thus make the height of the slow blow fuse 10 low.

Let it be supposed that the slow blow fuse 10 is accommodated in the fuse accommodation portion 45 of the electric junction box 40 by turning the main body 21 and the cover 22 upside down with either the main body 21 or the cover 22 located at the lower side of the slow blow fuse 10. The probe pin insertion ports 21*p* and 22*p* are formed through the bottom wall 21*a* of the main body 21 and the cover 22 respectively. Therefore it is possible to conduct a conductivity test by inserting a probe pin (not shown in the drawings) into the probe pin insertion port formed through the main body 21 or the cover 22 located at the upper side of the slow blow fuse 10.

Further the bottom wall 21*a* of the main body 21 is provided with the flange 21*a*-1 to make the outer configuration of the bottom wall 21*a* identical to that of the cover 22. Therefore even though the slow blow fuse 10 is mounted in the fuse accommodation portion 45 with the cover 22 and the main body 21 turned upside down, it is possible to fit the slow blow fuse 10 closely in the fuse accommodation portion 45 without loosening the slow blow fuse 10 and mount the slow blow fuse 10 therein stably.

As shown in FIG. 1, in the fuse element 11 of the slow blow fuse 10 of the first embodiment, the coupling part 14 having the fusing portion provided at its center couples a pair of the female terminal parts 12 and 13 to each other with the coupling part 14 projected outward beyond the female terminal parts 12 and 13. But it is possible to widen the interval between the female terminal parts 12 and 13 to dispose the coupling part 14 having the fusing portion in a space between the female terminal parts 12 and 13 by folding the fusing portion 14*a*. In this case, although the interval between the female terminal parts 12 and 13 is widened, it is possible to decrease the dimension of a portion of the coupling part 14 projected outward beyond the female terminal part.

In the first embodiment, the locking pieces 12*c*, 13*c* of the female terminal parts of the fuse element 11 are respectively locked to the lances 21*f* provided on the side wall 21*b* and the partitioning wall 21*d* to fixedly place the fuse element 11 in position inside the main body 21. But the locking pieces 12*c*, 13*c* do not necessarily have to be locked to both lances 21*f* provided on the side wall 21*b* and the partitioning wall 21*d*, but may be respectively locked to the lance 21*f* provided on the side wall 21*b* or the lance 21*f* provided on the partitioning wall 21*d*. In addition, it is possible that the locking pieces 12*c*, 13*c* and the lances 21*f* are not formed, but the input terminal part 12 and the output terminal part 13 may be fixed by press fit between the side wall 21*b* of the main body 21 and the partitioning wall 21*d*. Thereby it is possible to decrease the number of cut and raised portions for forming the locking pieces 12*c*, 13*c* and the number of the lances 21*f* and unnecessary to form the locking pieces 12*c*, 13*c* and the lances 21*f*, which facilitates the formation of the fuse element and the housing.

Further the configuration of the probe pin insertion ports 21*p* and 22*p* formed continuously with the insertion port 21*c* formed on the bottom wall 21*a* of the main body 21 and the cover 22 respectively are not regulated to that shown in FIG. 1. For example, the probe pin insertion ports 21*p*, 22*p* may have configurations, as shown in FIGS. 6(A) through 6(E).

Figure 6A:
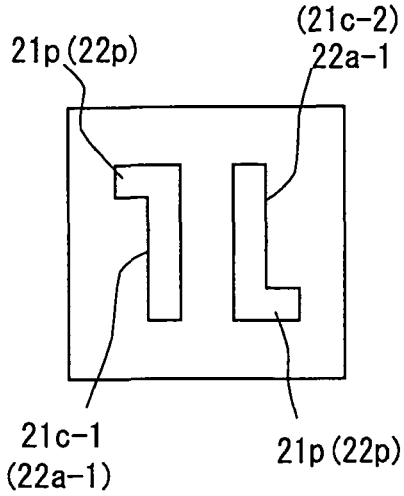
FIGS. 6(A) through 6(E) show modification examples of a probe pin insertion port formed continuously with an insertion port of the slow blow fuse.

In FIG. 6(A), the probe pin insertion ports 21*p* (22*p*) are formed by outwardly and rectangularly cutting the bottom wall 21*a* of the main body 21 and the cover 22 continuously with longitudinal opposite ends of a pair of each of the insertion ports 21*c*-1, 21*c*-2 (22*a*-1, 22*a*-2) arranged side by side.

Figure 6B:
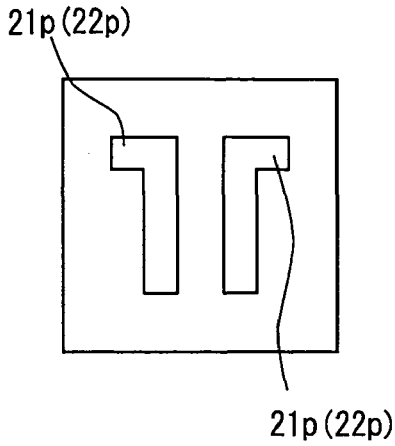

In FIG. 6(B), the probe pin insertion ports 21*p* (22*p*) are formed continuously with the insertion ports at the same-side ends thereof in the longitudinal direction thereof.

Figure 6C:
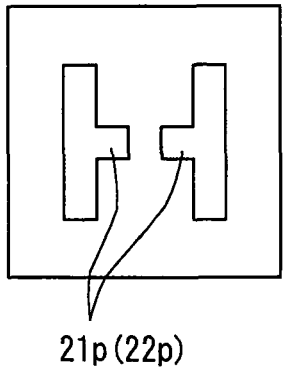

In FIG. 6(C), the probe pin insertion ports 21*p* (22*p*) are formed at the central position of each of the insertion ports in the longitudinal direction thereof with the probe pin insertion ports 21*p* (22*p*) projected inward in such a way that the probe pin insertion ports 21*p* (22*p*) approach each other.

Figure 6D:
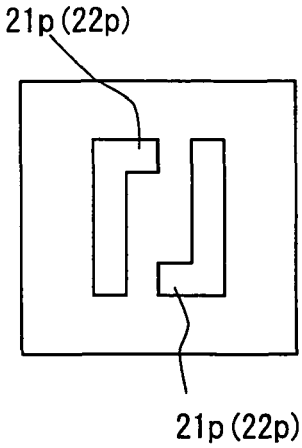

In FIG. 6(D), the probe pin insertion ports 21*p* (22*p*) are formed at opposite ends of the insertion ports in the longitudinal direction thereof with the probe pin insertion ports 21*p* (22*p*) projected inward.

Figure 6E:
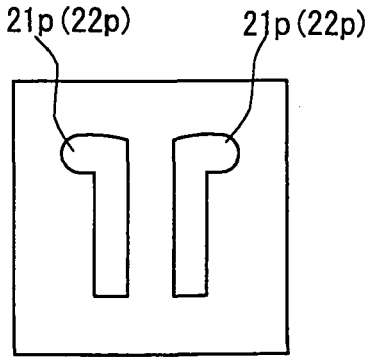

In FIG. 6(E), the probe pin insertion ports 21*p* (22*p*) are formed not rectangularly but semicircularly.

The position and configuration of the probe pin insertion port 21*p* (22P) are so set that a probe pin inserted into the probe pin insertion port 21*p* (22P) is capable of contacting the fuse element 11 with the probe pin locked at a predetermined normal position inside the housing 20.

Figure 7:
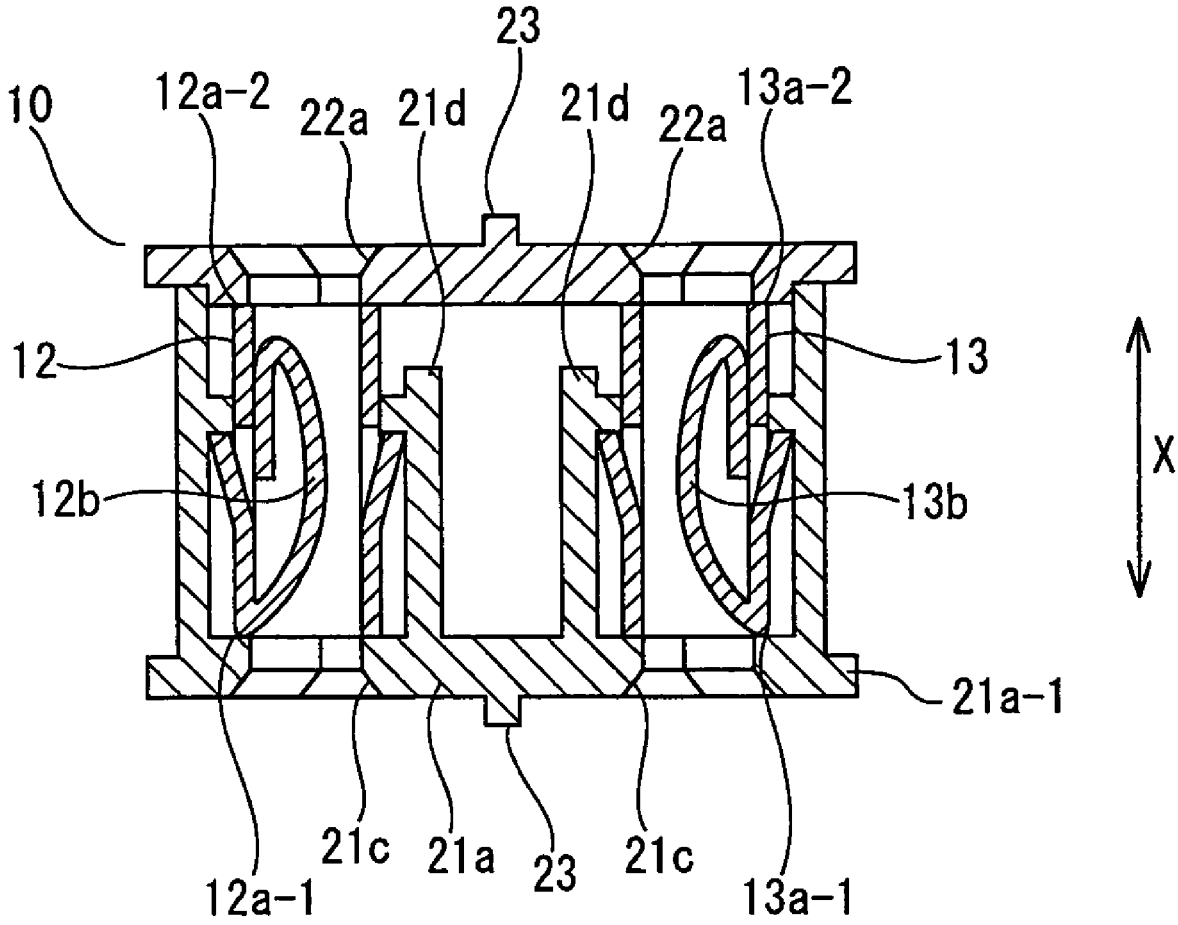
FIG. 7 is a sectional view showing a slow blow fuse of a second embodiment of the present invention.
Figure 8:
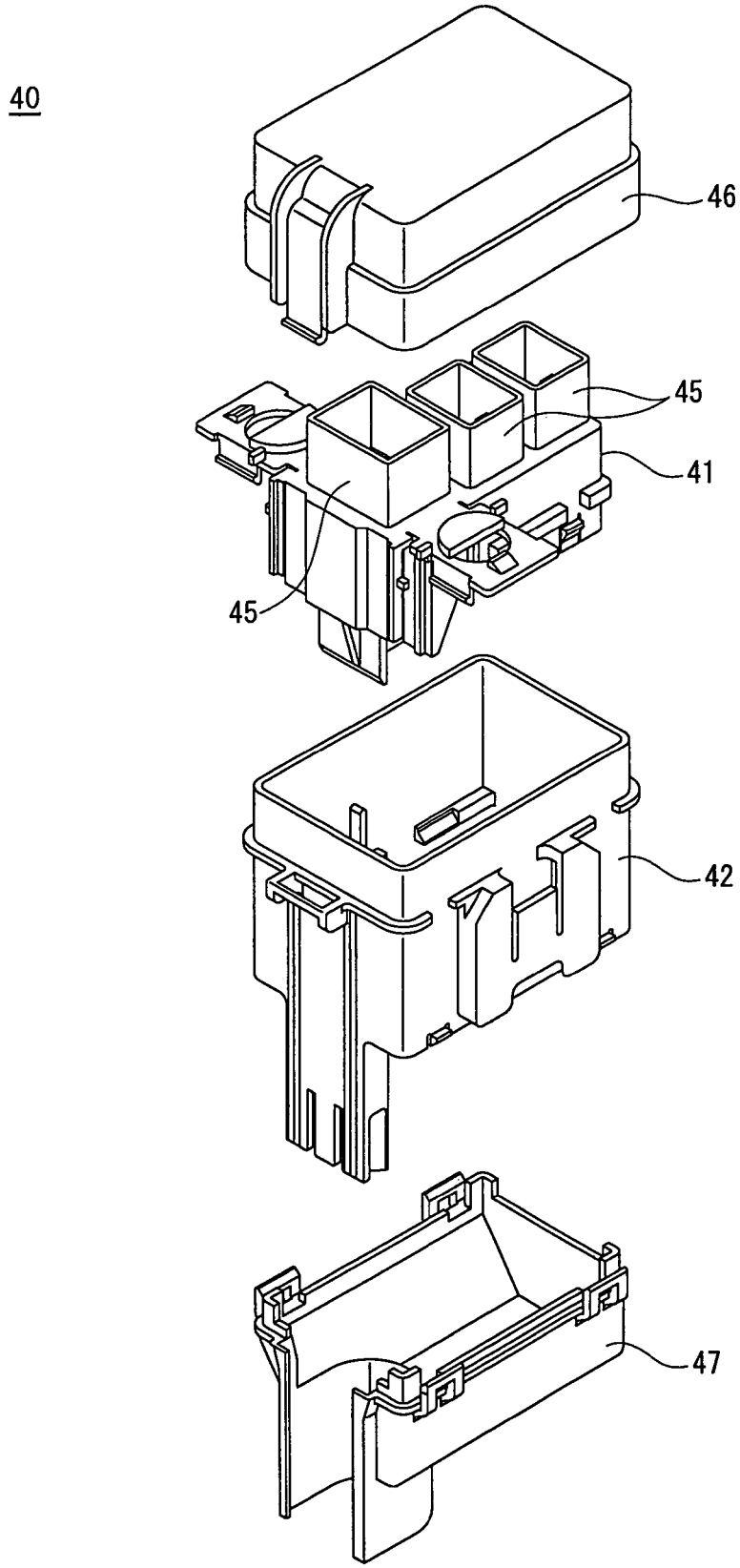
FIG. 8 is an exploded perspective view of an electric junction box where the slow blow fuse is mounted.

FIGS. 7 through 9 show a second embodiment of the present invention.

The slow blow fuse 10 of the second embodiment is connected with an internal circuit of the electric junction box 40 with the slow blow fuse 10 accommodated in the fuse accommodation portion 45 of the electric junction box 40.

As shown in FIG. 7, a convex portion 23 having a predetermined configuration is formed on an outer wall surface of the housing 20 through which the insertion ports 21*c*, 22*a* are formed. In one slow blow fuse 10, the convex portion 23 formed on the bottom wall 21*a* of the main body 21 and the convex portion 23 formed on the cover 22 have the same configuration and are formed at symmetrical positions.

A slow blow fuse 10' having a capacity different from that of the slow blow fuse 10 is provided with a convex portion having a configuration different from that of the slow blow fuse 10. In the slow blow fuse 10', the convex portions are also formed at symmetrical positions.

In the electric junction box 40, an internal circuit composed of bus bars 43 formed by punching a conductive metal plate into a predetermined configuration is accommodated inside a case consisting of an upper case 41 and a lower case 42. A tab-shaped terminal 44 provided at a distal end of the bus bar 43 is projected into the fuse accommodation portion 45 provided in the upper case 41. On the bottom wall 45*a* of the fuse accommodation portion 45, a concave portion 45*b* is formed in correspondence to the convex portion 23 formed on the housing 20 of the slow blow fuse 10.

An upper cover 46 is placed on the upper case 41, and a lower cover 47 is placed on the lower case 42 to waterproof the cases.

Figure 9A:
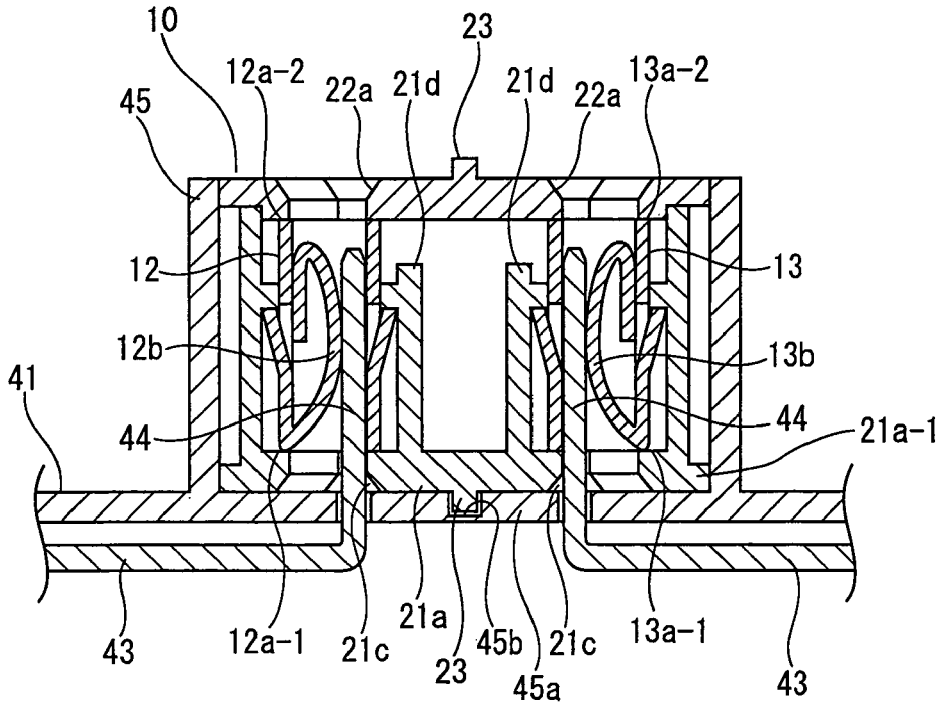
FIG. 9(A) is a sectional view showing a state in which a predetermined slow blow fuse is accommodated in a fuse accommodation portion of the electric junction box.

When the predetermined slow blow fuse 10 is accommodated in the fuse accommodation portion 45 of the electric junction box 40, as shown in FIG. 9(A), the convex portion 23 formed on an insertion-side end surface of the housing 20 of the slow blow fuse 10 fits in the concave portion 45*b* formed on the bottom wall 45*a* of the fuse accommodation portion 45, and the slow blow fuse 10 is inserted into the fuse accommodation portion 45 to a predetermined normal position thereof. At this time, the input terminal part 12 of the slow blow fuse 10 and the output terminal part 13 thereof are connected with the terminal 44 of the bus bar 43 composing the internal circuit of the electric junction box 40.

In one slow blow fuse 10, the configuration of the bottom wall 21*a* of the main body 21 and that of convex portion 23 formed on the cover 22 are identical to each other. Thus even though the slow blow fuse 10 is inserted into the fuse accommodation portion 45 with the slow blow fuse turned upside down, the convex portion 23 formed on the slow blow fuse 10 fits in the concave portion 45*b* formed on the fuse accommodation portion 45, and the slow blow fuse 10 can be inserted into the fuse accommodation portion 45 to the predetermined normal position thereof.

Figure 9B:
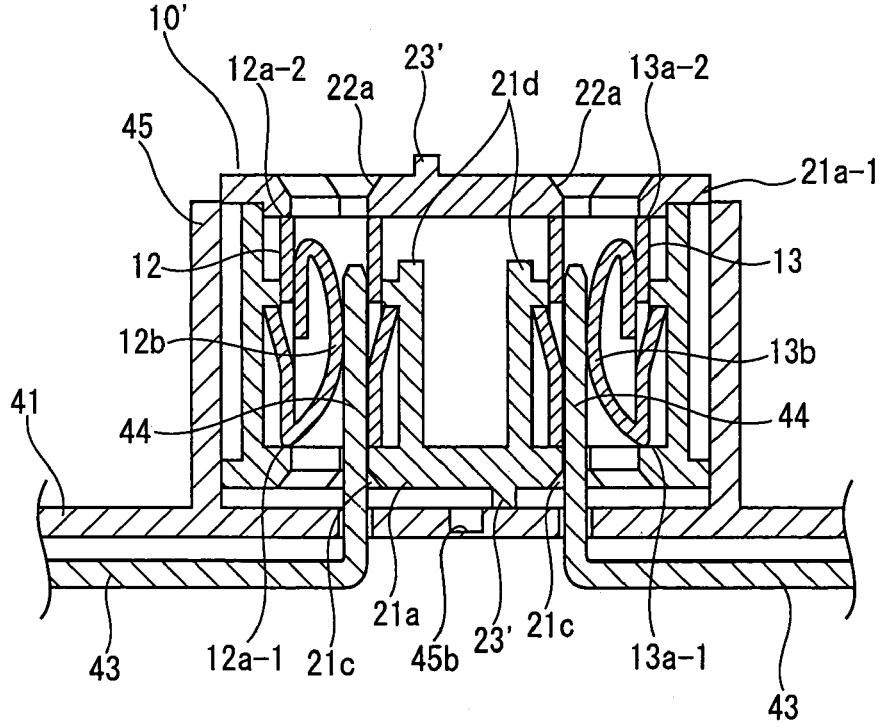
FIG. 9(B) is a sectional view showing a state in which a slow blow fuse other than the predetermined slow blow fuse is accommodated in the fuse accommodation portion.

As shown in FIG. 9(B), when the predetermined slow blow fuse 10' having the capacity different from that of the slow blow fuse 10 is inserted into the fuse accommodation portion 45, the configuration and disposition of a convex portion 23' of the slow blow fuse 10' are different from those of the convex portion 23 of the slow blow fuse 10. Therefore the convex portion 23' interferes with the bottom wall 45*a* of the fuse accommodation portion 45 and thus the slow blow fuse 10' cannot be inserted thereinto to the predetermined normal position.

Thereby it is possible to confirm that the slow blow fuse 10' has been erroneously inserted into the predetermined normal position.

The second embodiment has the same construction, operation, and effect as those of the first embodiment. Thus the same parts of the second embodiment as those of the first embodiment are denoted by the same reference numerals as those of the first embodiment, and description thereof is omitted herein.

Figure 10:
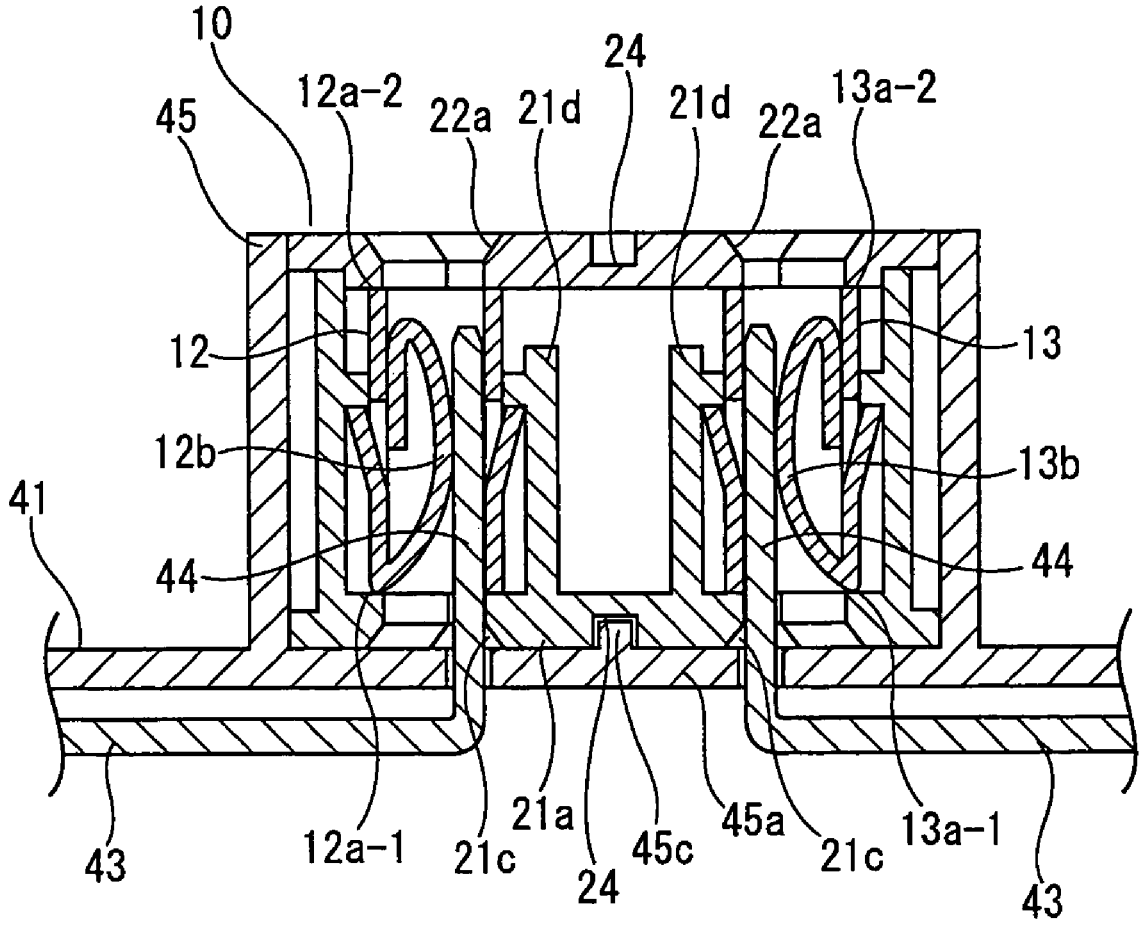
FIG. 10 shows a modification example of the second embodiment.
Figure 11:
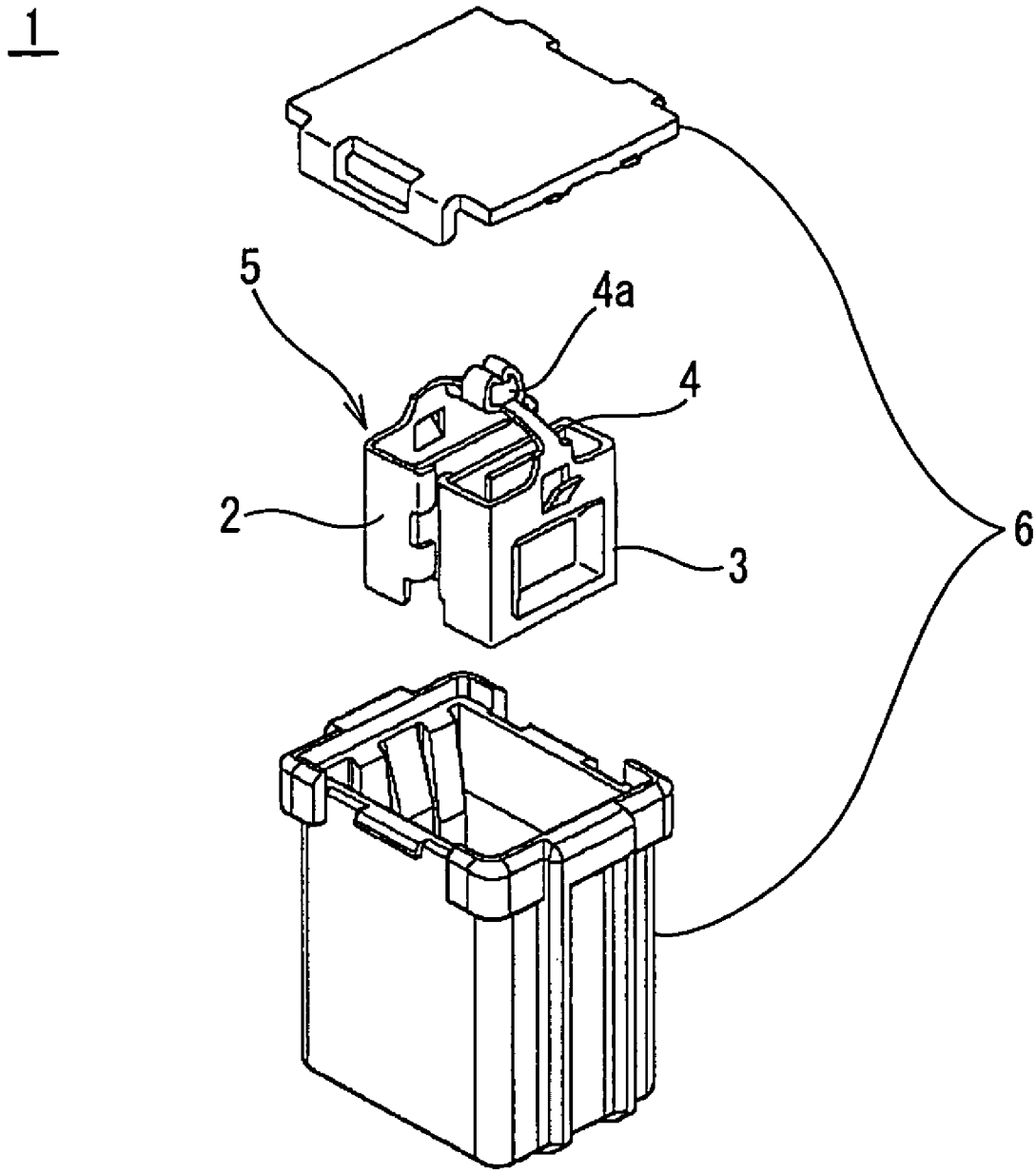
FIG. 11 shows an example of a conventional art.

FIG. 10 shows a modification example of the second embodiment.

In the modification example, the housing 20 of the slow blow fuse 10 is provided with an erroneous insertion prevention concave portion 24, and a bottom wall 45*a* of the fuse accommodation portion 45 of the electric junction box 40 is provided with a convex portion 45*c* which fits in the erroneous insertion prevention concave portion 24.

In the modification example, a slow blow fuse having a capacity different from that of the slow blow fuse 10 is provided with a convex portion having a configuration different from that of the slow blow fuse 10, and the fuse accommodation portion is provided with a convex portion whose configuration corresponds to that of the convex portion of the slow blow fuse to be inserted thereinto.

In the above-described construction, a slow blow fuse other than the predetermined slow blow fuse is inserted into the fuse accommodation portion 45, the convex portion 45*c* of the fuse accommodation portion 45 interferes the insertion-side front-end surface of the housing of the slow blow fuse 10. Thus it is possible to prevent an erroneous insertion of the slow blow fuse 10.

What is claimed is:

1. A slow blow fuse in which a fuse element is accommodated in a housing made of an insulating resin; and insertion ports into which mating terminals can be inserted from upper and lower sides of said housing;

wherein said fuse element comprises a pair of female terminal parts, disposed in parallel, into which said mating terminals are plugged; a fusing portion coupling a pair of said female terminal parts to each other in a direction orthogonal to a direction in which said mating terminals are plugged into said female terminal parts; and said female terminal parts have plugging ports for said mating terminals at vertical upper and lower ends thereof; an edge of a left side surface or a right side surface of one of said female terminal parts and an edge of a left side surface or a right side surface of the other female terminal part are coupled to each other by a coupling part having said fusing portion at a center thereof; and said coupling part is located at a position proximate to one of said plugging ports disposed at said vertical upper and lower ends of said female terminal parts.

2. A slow blow fuse according to claim 1, wherein said housing comprises an uncovered main body composed of a bottom wall, a side wall, and a cover for closing said uncovered main body; and said insertion ports are formed through said bottom wall of said main body and said cover confronting said bottom wall.

3. A slow blow fuse according to claim 1, wherein probe pin insertion ports, for examining electrical conductivity, continuous with said insertion ports respectively are provided.

4. A slow blow fuse according to claim 2, wherein a flange portion is projected from a periphery of said bottom wall of said main body of said housing.

5. A slow blow fuse according to claim 2, wherein a concave portion or/and a convex portion for placing said slow blow fuse in position in a fuse accommodation portion and preventing an erroneous connection are provided on an outer surface of said housing.

6. An electric junction box having a fuse accommodation portion for accommodating a slow blow fuse according to claim 1.

7. An electric junction box according to claim 6, wherein a bottom wall of said fuse accommodation portion is provided with a convex portion or/and a concave portion which engage said concave portion or/and said convex portion formed on said housing respectively.

8. A slow blow fuse according to claim 2, wherein probe pin insertion ports, for examining electrical conductivity, continuous with said insertion ports respectively are provided.

9. A slow blow fuse according to claim 3, wherein a flange portion is projected from a periphery of said bottom wall of said main body of said housing.

10. A slow blow fuse according to claim 3, wherein a concave portion or/and a convex portion for placing said slow blow fuse in position in a fuse accommodation portion and preventing an erroneous connection are provided on an outer surface of said housing.

11. An electric junction box having a fuse accommodation portion for accommodating a slow blow fuse according to claim 2.

* * * * *